US011516590B2

(12) United States Patent
Yan et al.

(10) Patent No.: US 11,516,590 B2
(45) Date of Patent: Nov. 29, 2022

(54) SOUNDING DEVICE

(71) Applicant: AAC Microtech (Changzhou) Co., Ltd., Changzhou (CN)

(72) Inventors: Xudong Yan, Shenzhen (CN); Tao Shao, Shenzhen (CN); Xiaojiang Gu, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/535,718

(22) Filed: Nov. 26, 2021

(65) Prior Publication Data

US 2022/0174413 A1 Jun. 2, 2022

(30) Foreign Application Priority Data

Nov. 30, 2020 (CN) ..... 202011380517.X

(51) Int. Cl.
*H04R 9/02* (2006.01)
*H04R 7/12* (2006.01)
*H04R 9/04* (2006.01)

(52) U.S. Cl.
CPC ..... *H04R 9/025* (2013.01); *H04R 7/127* (2013.01); *H04R 9/043* (2013.01)

(58) Field of Classification Search
CPC ..... H04R 7/127; H04R 9/043; H04R 9/025
See application file for complete search history.

(56) References Cited

FOREIGN PATENT DOCUMENTS

| | | | | |
|---|---|---|---|---|
| CN | 110430510 A | | 11/2019 | |
| CN | 209982716 U | | 1/2020 | |
| CN | 211959524 U | * | 11/2020 | |
| CN | 211959524 U | | 11/2020 | |
| WO | WO-2021097954 A1 | * | 5/2021 | ..... H04R 9/025 |

OTHER PUBLICATIONS

1st Office Action dated Jun. 2, 2021 by SIPO in related Chinese Patent Application No. 202011380517.X(8 Pages.
2nd Office Action dated Dec. 23, 2021 by SIPO in related Chinese Patent Application No. 202011380517.X(7 Pages).
PCT search report dated Sep. 2, 2021 by SIPO in related PCT Patent Application No. PCT/CN2020/136971 (5 Pages).

* cited by examiner

*Primary Examiner* — Sunita Joshi
(74) *Attorney, Agent, or Firm* — W&G Law Group

(57) ABSTRACT

A sounding device includes a bracket having a receiving space, a vibration system, and a magnetic circuit unit. The magnetic circuit unit drives the vibration system to vibrate. The magnetic circuit unit includes a first magnetic body, a second magnetic body, and a yoke. The yoke includes a bottom wall, a first sidewall, and a second sidewall. The first sidewall and the second sidewall is fixed to the bracket. The first sidewall and the bottom wall form a first groove accommodating the first magnetic body, and the second sidewall and the bottom wall from a second groove accommodating the second magnetic body. An opening of the first groove is oriented opposite to an opening of the second groove. The vibration system includes first and second vibration portions. The magnetic circuit unit is arranged between the first and second vibration portions. In this way, a thin sounding device can be realized.

19 Claims, 10 Drawing Sheets

SOUNDING DEVICE

TECHNICAL FIELD

The present disclosure relates to the field of acoustoelectric conversion, and in particular, to a sounding device.

BACKGROUND

With the development of the field of acoustoelectric conversion and the improvement in user requirements, in order to realize the pursuit of double-sided sounding of sounding devices, in the related art, two sets of sounding systems are arranged in a sounding device, so that the sounding device can meet the requirement for double-sided sounding of the sounding device. However, double-sided sounding devices in the related art are generally large in volume and weight, which cannot meet users' requirement for lightweight and thinness of the sounding device.

Therefore, there is a need to provide a sounding device to solve the above technical problems.

SUMMARY

An objective of the present disclosure is to provide a sounding device, so as to realize a thin sounding device.

The technical solution of the present disclosure is as follows. A sounding device includes a bracket having a receiving space, and a vibration system and a magnetic circuit unit that are fixedly connected and received in the receiving space. The magnetic circuit unit is configured to drive the vibration system to vibrate. The magnetic circuit unit includes a first magnetic body, a second magnetic body, and a yoke configured to carry the first magnetic body and the second magnetic body, and the yoke includes a bottom wall, a first sidewall arranged on one side of the bottom wall, and a second sidewall arranged on another side of the bottom wall. At least one of the bottom wall, the first sidewall, or the second sidewall is fixed to the bracket. The first sidewall and the bottom wall form a first groove accommodating the first magnetic body, and the second sidewall and the bottom wall from a second groove accommodating the second magnetic body. An opening of the first groove is oriented towards a direction opposite to a direction towards which an opening of the second groove is oriented. The vibration system includes a first vibration portion and a second vibration portion that are opposite to and spaced apart from each other, and the magnetic circuit unit is arranged between the first vibration portion and the second vibration portion.

As an embodiment, the bracket includes an annular sidewall defining the receiving space, and a support arm extending inwards from the annular sidewall, the annular sidewall surrounds the yoke and is spaced apart from the yoke, the support arm is sandwiched between the annular sidewall and the yoke and is fixed to the yoke, and the first vibration portion and the second vibration portion cover two opposite ends of the annular sidewall, respectively.

As an embodiment, the first sidewall includes a connecting end connected to the bottom wall and a free end, the free end is provided with at least one limiting slot, and the support arm is provided with at least one limiting portion engaging with a wall of the at least one limiting slot, so as to connect the first sidewall and the support arm.

As an embodiment, the at least one limiting slot includes a plurality of limiting slots that is spaced apart from each other along a circumferential direction of the first sidewall, and the at least one limiting portion includes a plurality of limiting portions arranged in one-to-one correspondence to the plurality of limiting slots.

As an embodiment, an orthographic projection of the first magnetic body on the bottom wall overlaps with an orthographic projection of the second magnetic body on the bottom wall.

As an embodiment, the first groove is of a same size as the second groove.

As an embodiment, the first magnetic body includes a first surface in contact with a bottom of the first groove, and a second surface opposite to the first surface; the second magnetic body includes a third surface in contact with a bottom of the second groove, and a fourth surface opposite to the third surface; and the magnetic circuit unit further includes a first pole plate adjacent to the second surface, and a second pole plate adjacent to the fourth surface.

As an embodiment, the first vibration portion includes a first diaphragm covering one end of the annular sidewall, and a first voice coil connected to one side of the first diaphragm close to the first magnetic body. The second vibration portion includes a second diaphragm covering one end of the annular sidewall away from the first vibration portion, and a second voice coil connected to one side of the second diaphragm close to the second magnetic body. The first voice coil is suspended in a gap formed between the first magnetic body and a wall of the first groove, and the second voice coil is suspended in a gap formed between the second magnetic body and a wall of the second groove.

As an embodiment, the first diaphragm includes a first voice membrane fixed to the annular sidewall, a first dome attached to a middle portion of the first voice membrane and a first connector connected to the first dome, the first connector is located between the first voice coil and the first magnetic body and supports and fixes the first voice coil, the first magnetic body is configured to drive the first voice coil to vibrate so as to enable the first connector to drive the first dome to vibrate. The second diaphragm includes a second voice membrane fixed to the annular sidewall, a second dome attached to a middle portion of the second voice membrane, and a second connector connected to the second dome. The second connector is located between the second voice coil and the second magnetic body and supports and fixes the second voice coil, and the second magnetic body is configured to drive the second voice coil to vibrate so as to enable the second connector to drive the second dome to vibrate.

As an embodiment, the vibration system further includes a first damper and a second damper that are provided between the first dome and the second dome, a first support member sandwiched between the first dome and the first damper, and a second support member sandwiched between the second dome and the second damper. An avoiding through hole for avoiding the first damper and the second damper is correspondingly formed in the support arm. One side of the first damper away from the first support member is fixed to the bracket, and one side of the second damper away from the second support member is fixed to the bracket.

As an embodiment, the yoke is of formed into one piece.

The present disclosure has the following beneficial effects. The structure in which the first magnetic body and the second magnetic body share a yoke can reduce a thickness of the sounding device and realize a thin sounding device.

DESCRIPTION OF EMBODIMENTS

The technical solutions in the present disclosure will be described clearly and completely below with reference to the accompanying drawings in the present disclosure. The described embodiments are merely some of rather than all of the embodiments of the present disclosure. All other embodiments acquired by those skilled in the art based on the embodiments of the present disclosure shall fall within the protection scope of the present disclosure.

Figure 1:
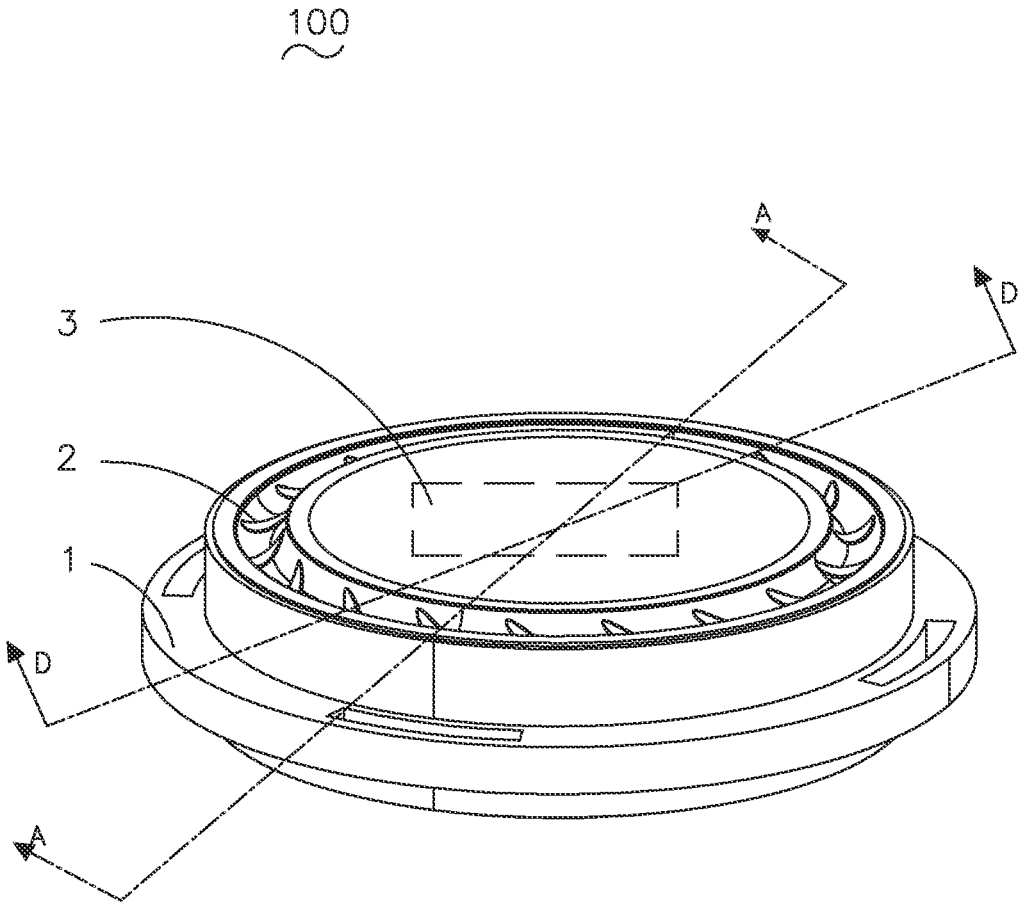
FIG. 1 is a schematic structural diagram of a sounding device according to the present disclosure.
Figure 2:
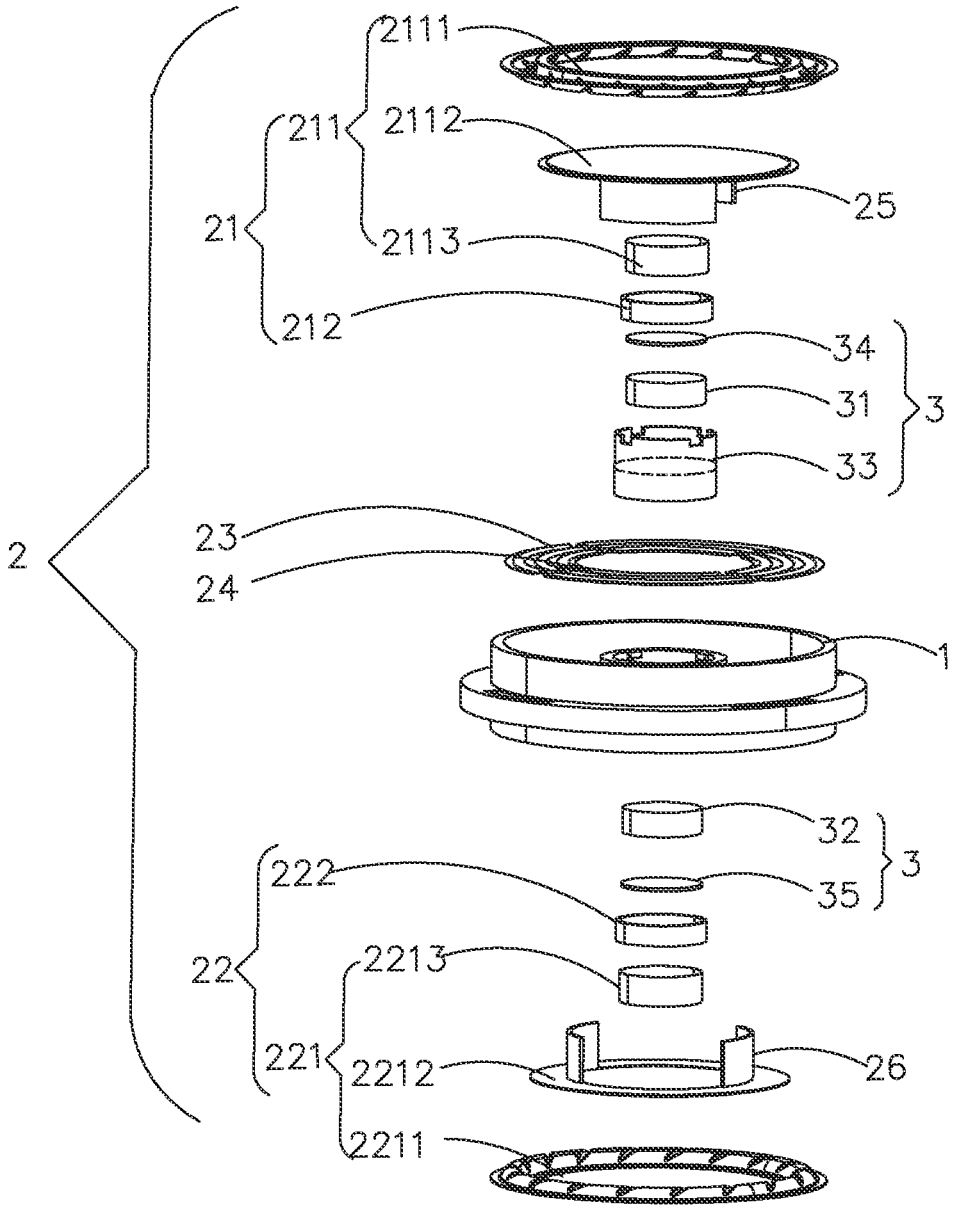
FIG. 2 is a schematic diagram of an exploded structure of the sounding device shown in FIG. 1.
Figure 3:
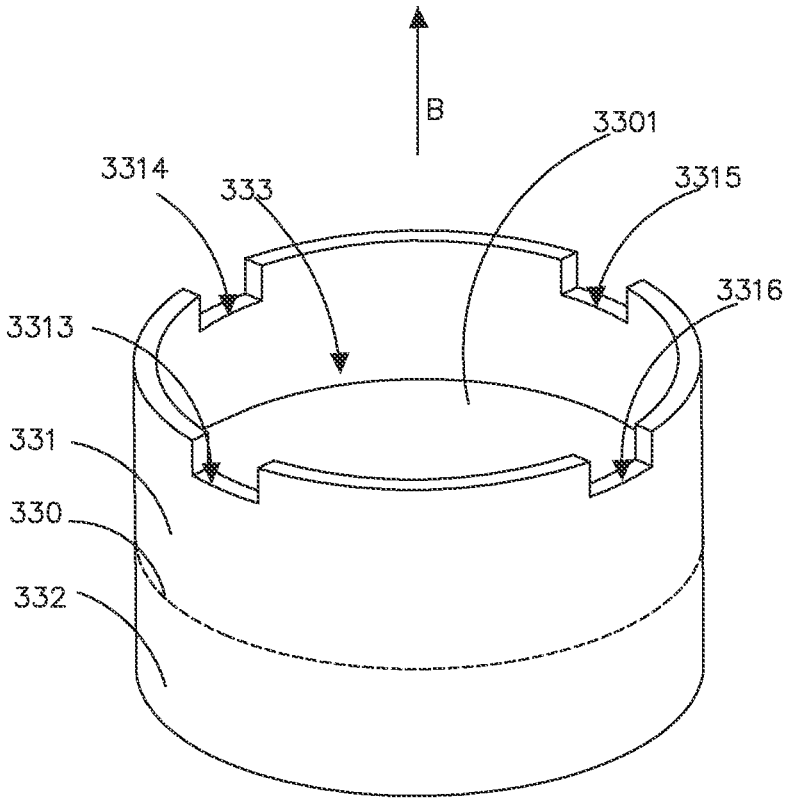
FIG. 3 is a schematic structural diagram of a first perspective of a yoke according to the present disclosure.
Figure 4:
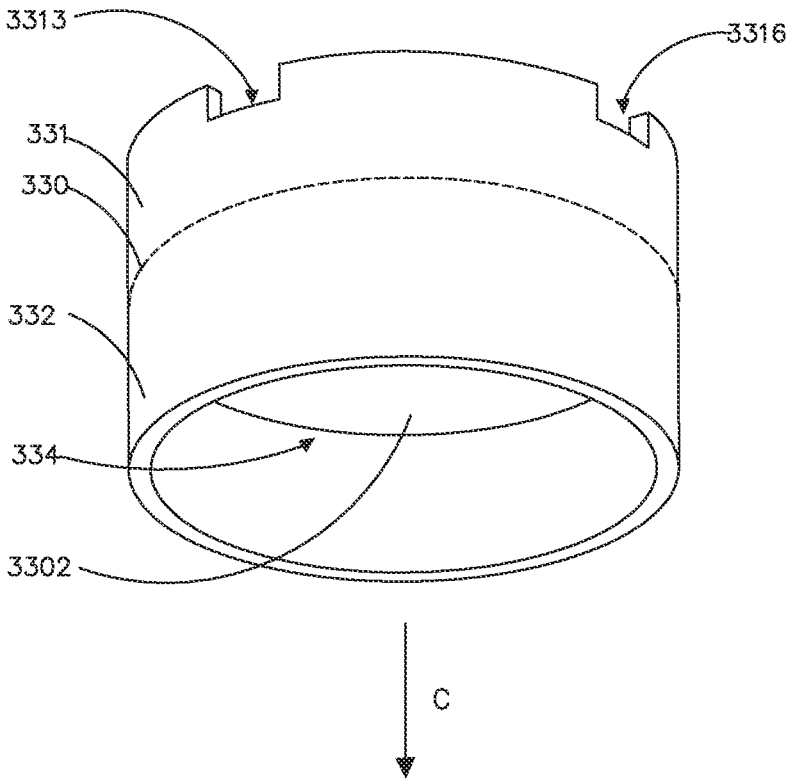
FIG. 4 is a schematic structural diagram of a second perspective of the yoke according to the present disclosure.

FIG. 1 is a schematic structural diagram of a sounding device according to the present disclosure, FIG. 2 is a schematic diagram of an exploded structure of the sounding device shown in FIG. 1, FIG. 3 is a schematic structural diagram of a first perspective of a yoke according to the present disclosure, and FIG. 4 is a schematic structural diagram of a second perspective of the yoke according to the present disclosure.

Referring to FIG. 1 to FIG. 4, a sounding device 100 includes a bracket 1 having a receiving space, and a vibration system 2 and a magnetic circuit unit 3 that are fixedly connected and received in the receiving space. The magnetic circuit unit 3 is configured to drive the vibration system 2 to vibrate. The magnetic circuit unit 3 includes a first magnetic body 31, a second magnetic body 32, and a yoke 33 configured to carry the first magnetic body 31 and the second magnetic body 32. The yoke 33 includes a bottom wall 330, a first sidewall 331 arranged on one side of the bottom wall 330, and a second sidewall 332 arranged on another side of the bottom wall 330. At least one of the bottom wall 330, the first sidewall 331 and the second sidewall 332 is fixed to the bracket 1. The first sidewall 331 and the bottom wall 330 form a first groove 333 accommodating the first magnetic body 31. The second sidewall 332 and the bottom wall 330 form a second groove 334 accommodating the second magnetic body 32. The vibration system 2 includes a first vibration portion 21 and a second vibration portion 22 that are opposite to and spaced apart from each other. The magnetic circuit unit 3 is arranged between the first vibration portion 21 and the second vibration portion 22. The structure in which the first magnetic body 31 and the second magnetic body 32 share a yoke can reduce a thickness of the sounding device and realize a thin sounding device.

The bracket 1 is of a fixed structure having a receiving space. The vibration system 2 and the magnetic circuit unit 3 are arranged in the receiving space of the bracket 1, and are fixedly connected to the bracket 1. The magnetic circuit unit 3 can drive the first vibration portion 21 and the second vibration portion 22 of the vibration system 2 to vibrate to enable the sounding device to produce sound. Exemplarily, the sounding device can produce sound in different directions.

The yoke 33 includes a bottom wall 330, a first sidewall 331, and a second sidewall 332. The bottom wall 330 includes an upper surface 3301 and a lower surface 3302 that are opposite to each other. The first sidewall 331 is arranged on one side of the bottom wall 330 and is adjacently connected to the upper surface 3301 of the bottom wall 330. The first sidewall is of an annular structure to form the first groove 333 with the bottom wall 330. An opening of the first groove 333 is oriented toward a first direction B. The first magnetic body 31 is fixedly arranged in the first groove 333. The second sidewall 332 is arranged on another side of the bottom wall 330 and is adjacently connected to the lower surface 3302 of the bottom wall 330. The second sidewall 332 is of an annular structure to form the second groove 334 with the bottom wall 330. An opening of the second groove 334 is oriented toward a second direction C. The first direction B and the second direction C are opposite to each other. The second magnetic body 32 is fixedly arranged in the second groove 334.

The yoke 33 is provided with the first groove 333 and the second groove 334 that share a bottom but have openings oriented towards opposite directions, the first magnetic body 31 is placed in the first groove 333, the second magnetic body 32 is placed in the second groove 334, and the first magnetic body 31 and the second magnetic body 32 share the yoke 33, which can reduce the number and volume of the yoke 33, and then can reduce a thickness of the sounding device 100, thereby realizing a thin sounding device.

Figure 5:
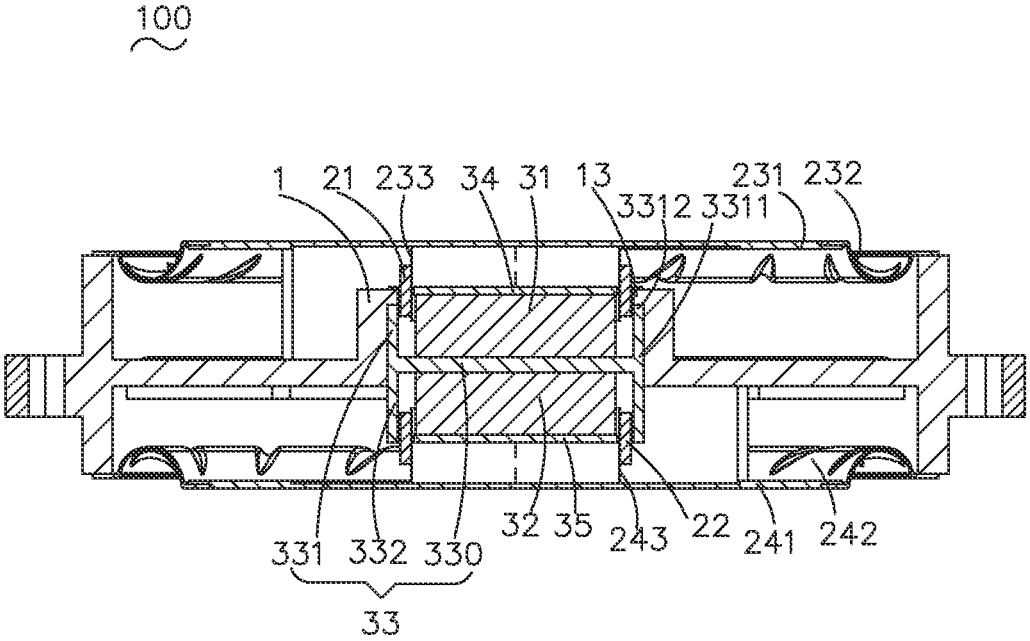
FIG. 5 is a sectional view of the sounding device shown in FIG. 1 taken along a direction A-A.
Figure 6:
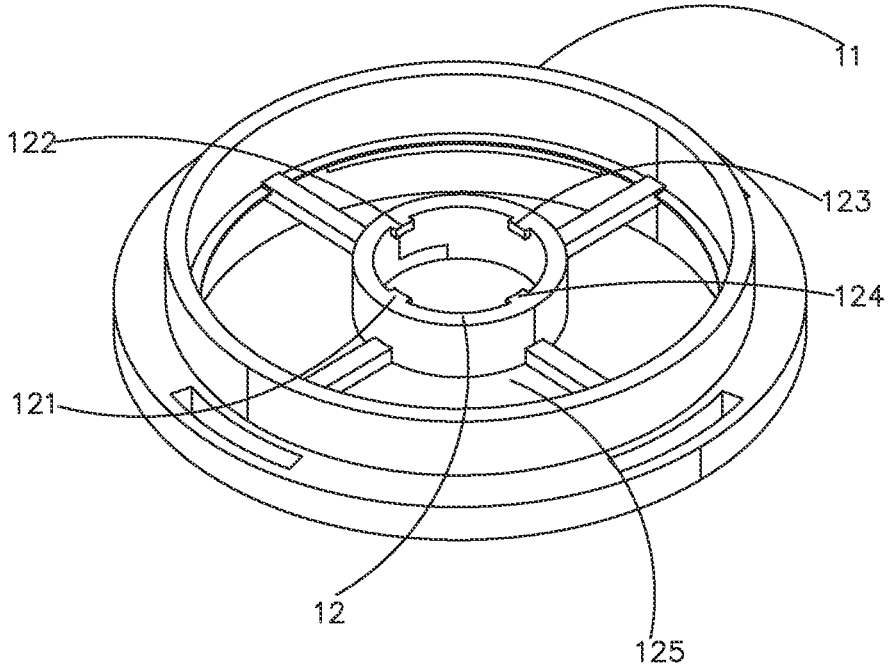
FIG. 6 is a schematic structural diagram of a bracket according to the present disclosure.

FIG. 5 is a sectional view of the sounding device shown in FIG. 1 taken along a direction A-A, and FIG. 6 is a schematic structural diagram of a bracket according to the present disclosure.

Referring to FIG. 2 to FIG. 6, the bracket 1 includes an annular sidewall 11 defining the receiving space, and a support arm 12 extending inwards from the annular sidewall 11. The annular sidewall 11 surrounds the yoke 33 and is spaced apart from the yoke 33. The support arm 12 is sandwiched between the annular sidewall 11 and the yoke 33 and is fixed to the yoke 33. The first vibration portion 21 and the second vibration portion 22 cover two opposite ends of the annular sidewall 11, respectively.

The first sidewall 331 includes a connecting end 3311 connected to the upper surface 3301 of the bottom wall 330, and a free end 3312. The free end 3312 is provided with at least one limiting slot, such as a first limiting slot 3313. The support arm 12 is provided with a limiting portion, such as a first limiting portion 121, engaging with a wall of the first limiting slot 3313, so as to fixedly connect the first sidewall 331 and the support arm 12. An opening of the first limiting slot 3313 is oriented towards a same direction as a direction towards which an opening of the first groove 333 is oriented. The support arm 12 protrudes toward the first sidewall 331 to form the first limiting portion 121. A size of the first limiting slot 3313 matches a size of the first limiting portion 121 so that the first limiting portion 121 can be engaged with the first limiting slot 3313, and the yoke 33 and the bracket 1 are fixedly connected to each other.

In order to improve stability of the connection between the yoke 33 and the bracket 1, in some embodiments, the free end 3312 of the first sidewall 331 is provided with multiple limiting slots, such as the first limiting slot 3313, a second limiting slot 3314, a third limiting slot 3315, and a fourth limiting slot 3316. The first limiting slot 3313, the second limiting slot 3314, the third limiting slot 3315, and the fourth limiting slot 3316 are spaced apart from each other along a circumferential direction of the first sidewall 331. The first limiting slot 3313 and the third limiting slot 3315 are opposite to each other, and the second limiting slot 3314 and the fourth limiting slot 3316 are opposite to each other. Correspondingly, the support arm 12 is provided with the first limiting portion 121 engaged with a wall of the first limiting slot 3313, a second limiting portion 122 engaged with a wall of the second limiting slot 3314, a third limiting portion 123 engaged with a wall of the third limiting slot 3315, and a fourth limiting portion 124 engaged with a wall of the fourth limiting slot 3316. Openings of the first limiting slot 3313, the second limiting slot 3314, the third limiting slot 3315, and the fourth limiting slot 3316 are oriented towards a same direction as the opening of the first groove 333. The support arm 12 protrudes towards the first sidewall 331 to form the first limiting portion 121, the second limiting portion 122, the third limiting portion 123, and the fourth limiting portion 124. A size of the first limiting slot 3313 matches a size of the first limiting portion 121, a size of the second limiting slot 3314 matches a size of the second limiting portion 122, a size of the third limiting slot 3315 matches a size of the third limiting portion 123, and a size of the fourth limiting slot 3316 matches a size of the fourth limiting portion 124, so that the yoke 33 and the bracket 1 are connected to each other. In this way, the stability of the connection between the yoke 33 and the bracket 1 can be improved.

In some embodiments, the bottom wall 330, the first sidewall 331, and the second sidewall 332 that are separately formed can be assembled to form the yoke 33. In another embodiment, the first sidewall 331 and the bottom wall 330 are formed into one piece, and the second sidewall 332 is assembled with the first sidewall 331 and the bottom wall 330 that are formed into one piece, to form the yoke 33. In another embodiment, the second sidewall 332 and the bottom wall 330 are formed into one piece, and the first sidewall 331 is assembled with the second sidewall 332 and the bottom wall 330 that are formed into one piece, to form the yoke 33. In order to improve the stability of the yoke 33, the bottom wall 330, the first sidewall 331, and the second sidewall 332 can also be formed into one piece to form the yoke 33.

Still referring to FIG. 2 and FIG. 5, in order to increase space utilization of the bracket 1 and reduce the volume of the yoke, the first groove 333 can be of a same size as the second groove 334. Exemplarily, a groove depth and a groove width of the first groove 333 are the same as a groove depth and a groove width of the second groove 334, respectively, so that the yoke forms an "H"-shaped structure.

In order to improve magnetic conductivity efficiency of the magnetic circuit unit 3, a magnetic pole of the first magnetic body 31 close to the second magnetic body 32 is a first magnetic pole, a magnetic pole of the first magnetic body 31 away from the second magnetic body 32 is a second magnetic pole, a magnetic pole of the second magnetic body 32 close to the first magnetic body 31 is a third magnetic pole, and a magnetic pole of the second magnetic body 32 away from the first magnetic body 31 is a fourth magnetic pole. A polarity of the first magnetic pole is the same as a polarity of the third magnetic pole and opposite to a polarity of the second magnetic pole, and a polarity of the third magnetic pole is opposite to a polarity of the fourth magnetic pole, so as to form a magnetic circuit unit in which a magnetization direction of the first magnetic body is opposite to a magnetization direction of the second magnetic body. Exemplarily, the first magnetic pole can be an "N" pole, the second magnetic pole can be an "S" pole, the third magnetic pole can be an "N" pole, and the fourth magnetic pole can be an "S" pole. Exemplarily, the first magnetic pole can be an "S" pole, the second magnetic pole can be an "N" pole, the third magnetic pole can be an "S" pole, and the fourth magnetic pole can be an "N" pole.

In an embodiment, in order to improve the magnetic conductivity efficiency of the magnetic circuit unit 3, the first magnetic body 31 and the second magnetic body 32 are aligned with each other, that is, an orthographic projection of the first magnetic body 31 on the bottom wall 330 overlaps with an orthographic projection of the second magnetic body 32 on the bottom wall 330. In a case where the magnetization direction of the first magnetic body 31 is opposite to the magnetization direction of the second magnetic body 32, the alignment of the first magnetic body 31 and the second magnetic body 32 enables the magnetic circuit unit 3 to form a top-to-top magnetic circuit structure, which improves the magnetic conductivity efficiency of the magnetic circuit unit 3. In order to balance the structure of the magnetic circuit unit 3, the first magnetic body 31 and the second magnetic body 32 are of a same size. In an embodiment, the first magnetic body 31 and the second magnetic body 32 can be of a cylindrical structure, which can improve space utilization of the first groove 333 and the second groove 334. In some embodiments, in order to balance the magnetic conductivity of the magnetic circuit unit, the first magnetic body 31 and the second magnetic body 32 have a same amount of magnetization.

In order to improve the magnetic conductivity efficiency of the magnetic circuit unit 3, the magnetic circuit unit 3 can further include a first pole plate 34 and a second pole plate 35. The first magnetic body 31 includes a first surface 311 in contact with a bottom of the first groove 333, and a second surface 312 arranged opposite to the first surface 311. The first pole plate 34 is adjacently connected to the second surface 312. The second magnetic body 32 includes a third surface 313 in contact with a bottom of the second groove 334, and a fourth surface 314 arranged opposite to the third surface 313. The second pole plate 35 is adjacently connected to the fourth surface 314. The first pole plate 34 can direct a direction of a magnetic field generated by the first magnetic body 31 to the first voice coil 21. The second pole plate 35 can direct a direction of a magnetic field generated by the second magnetic body 32 to the second voice coil 22.

Figure 7:
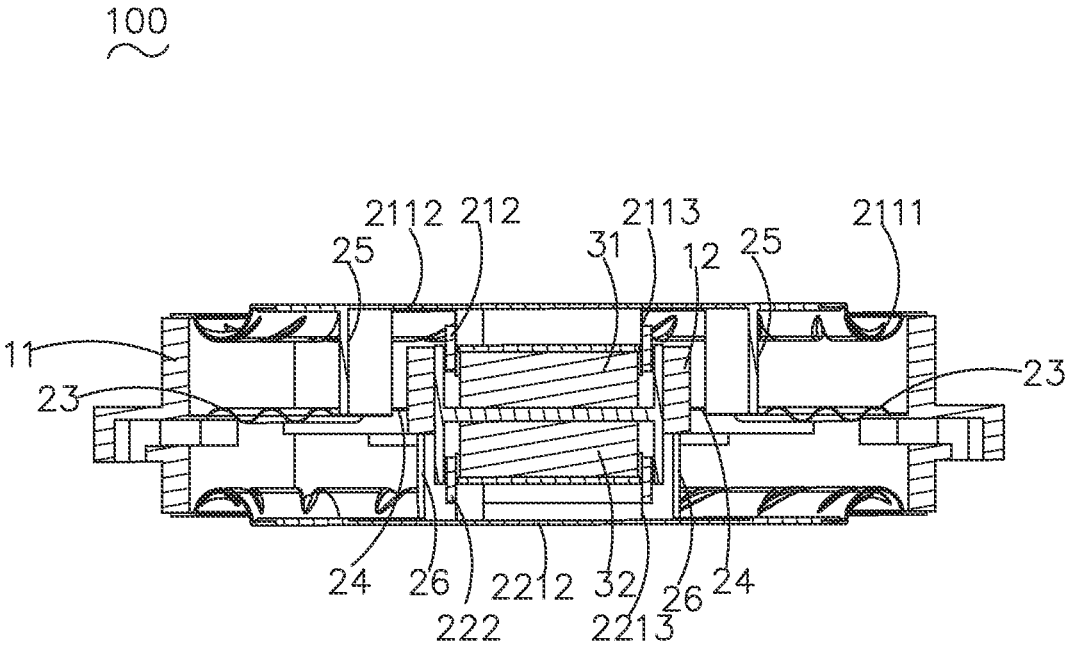
FIG. 7 is a sectional view of the sounding device shown in FIG. 1 taken along a direction D-D.
Figure 8:
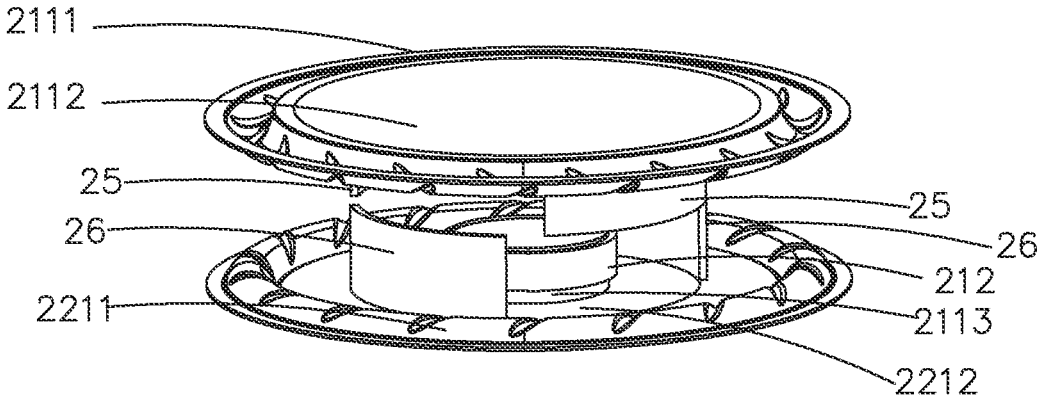
FIG. 8 is a schematic structural diagram of a first perspective of a vibration system according to the present disclosure.
Figure 9:
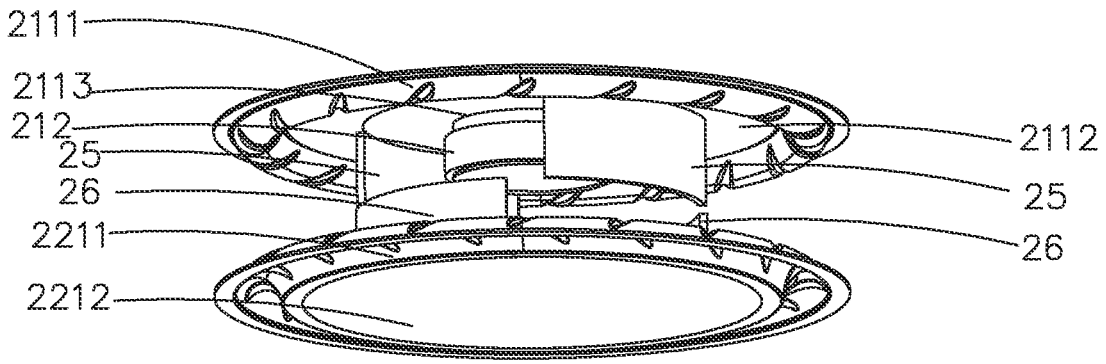
FIG. 9 is a schematic structural diagram of a second perspective of the vibration system according to the present disclosure.
Figure 10:
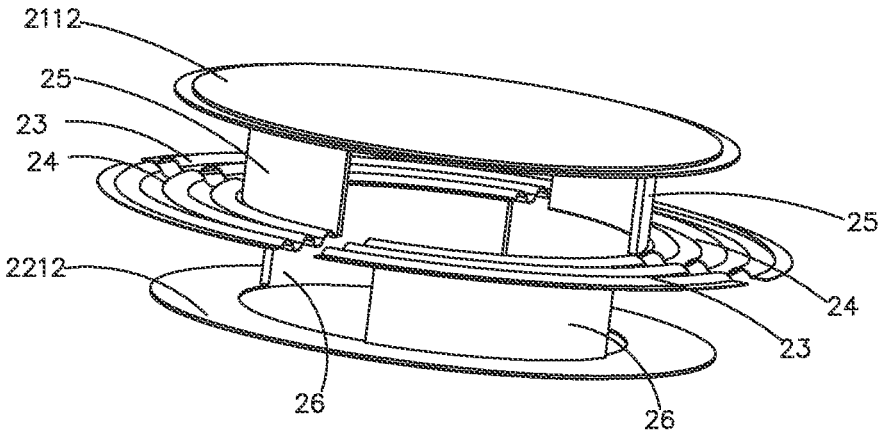
FIG. 10 is a schematic structural diagram of a first dome, a second dome, a first support member, a second support member, a first damper and a second damper according to the present disclosure.

In an embodiment of the present disclosure, the vibration system 2 includes a first vibration portion 21 and a second vibration portion 22. FIG. 7 is a sectional view of the sounding device shown in FIG. 1 taken along a direction D-D, FIG. 8 is a schematic structural diagram of a first perspective of a vibration system according to the present disclosure, FIG. 9 is a schematic structural diagram of a second perspective of the vibration system according to the present disclosure, and FIG. 10 is a schematic structural diagram of a first dome, a second dome and dampers according to the present disclosure.

Referring to FIG. 2 and FIG. 6 to FIG. 10, the first vibration portion 21 includes a first diaphragm 211 covering one end of the annular sidewall 11 and a first voice coil 212 connected to one side of the first diaphragm 211 close to the first magnetic body 31. The second vibration portion 22 includes a second diaphragm 221 covering one end of the annular sidewall 11 away from the first vibration portion 21 and a second voice coil 222 connected to one side of the second diaphragm 221 close to the second magnetic body 32. The first voice coil 212 is suspended in a gap formed between the first magnetic body 31 and a wall of the first groove 332. The second voice coil 222 is suspended in a gap formed between the second magnetic body 32 and a wall of the second groove 334.

The first diaphragm 211 includes a first voice membrane 2111 fixed to the annular sidewall 11, a first dome 2112 attached to a middle portion of the first voice membrane 2111, and a first connector 2113 connected to the first dome 2112. The first connector 2113 is located between the first voice coil 212 and the first magnetic body 31 and supports and fixes the first voice coil 212. The first magnetic body 31 is configured to drive the first voice coil 212 to vibrate so as to enable the first connector 2113 to drive the first dome 2112 to vibrate.

The second diaphragm 221 includes a second voice membrane 2211 fixed to the annular sidewall 11, a second dome 2212 attached to a middle portion of the second voice membrane 2211, and a second connector 2213 connected to the second dome 2212. The second connector 2213 is located between the second voice coil 222 and the second magnetic body 32 and supports and fixes the second voice coil 222. The second magnetic body 32 is configured to drive the second voice coil 222 to vibrate so as to enable the second connector 2213 to drive the second dome 2211 to vibrate.

The first voice coil 212 is of a hollow ring-shaped structure. The first voice coil 212 is sleeved on outer sides of the first magnetic body 31 and the first pole plate 34. A part of the first magnetic body 31 and the first pole plate 34 are located in a hollow region of the first voice coil 212. A center point of the first voice coil 212 can overlap with a center point of the first pole plate 34.

The second voice coil 222 is of a hollow ring-shaped structure. The second voice coil 222 is sleeved on outer sides of the second magnetic body 32 and the second pole plate 35. A part of the second magnetic body 32 and the second pole plate 35 are located in a hollow region of the second voice coil 222. A center point of the second voice coil 222 can overlap with a center point of the second pole plate 35.

The magnetic circuit unit 3 can drive the first voice coil 212 and the second voice coil 222 to vibrate simultaneously, so as to enable the first voice coil 212 to drive the first diaphragm 211 adjacent to the first voice coil 212, and the second voice coil 222 drives the second voice coil 222 to vibrate, so as to enable the second voice coil 212 to drive the second diaphragm 221 adjacent to the second voice coil 212, so that the sounding device 100 can sound in at least two different directions to achieve an effect of double-sided sounding.

The vibration system 2 can further include a first damper 23 and a second damper 24 that are provided between the first dome 2112 and the second dome 2212, a first support member 25 sandwiched between the first dome 2112 and the first damper 23, and a second support member 26 sandwiched between the second dome 2212 and the second damper 24. An avoiding through hole 125 for avoiding the first damper 23 and the second damper 24 is correspondingly formed in the support arm 12. One side of the first damper 23 away from the first support member 25 is fixed to the bracket 1. One side of the second damper 24 away from the second support member 26 is fixed to the bracket 1.

With the first damper 23 and the second damper 24 that are sandwiched between the first dome 2112 and the second dome 2212, vibration effects of the first dome 2112 and the second dome 2212 can be enhanced.

The above are only embodiments of the present disclosure. It should be noted that those of ordinary skill in the art can also make improvements without departing from the principle of the present disclosure, all of which fall within the protection scope of the present disclosure.

What is claimed is:

1. A sounding device, comprising:

a bracket having a receiving space;

a vibration system and a magnetic circuit unit that are fixedly connected and received in the receiving space, wherein the magnetic circuit unit is configured to drive the vibration system to vibrate and comprises a first magnetic body, a second magnetic body, and a yoke configured to carry the first magnetic body and the second magnetic body, wherein the yoke comprises a bottom wall, a first sidewall arranged on one side of the bottom wall, and a second sidewall arranged on another side of the bottom wall, wherein at least one of the bottom wall, the first sidewall, or the second sidewall is fixed to the bracket; the first sidewall and the bottom wall form a first groove accommodating the first magnetic body, the second sidewall and the bottom wall form a second groove accommodating the second magnetic body, and an opening of the first groove is oriented towards a direction opposite to a direction towards which an opening of the second groove is oriented; and the vibration system comprises a first vibration portion and a second vibration portion that are opposite to and spaced apart from each other, and the magnetic circuit unit is arranged between the first vibration portion and the second vibration portion, wherein an orthographic projection of the first magnetic body on the bottom wall overlaps with an orthographic projection of the second magnetic body on the bottom wall.

2. The sounding device as described in claim 1, wherein the bracket comprises an annular sidewall defining the receiving space, and a support arm extending inwards from the annular sidewall, wherein the annular sidewall surrounds the yoke and is spaced apart from the yoke, the support arm is sandwiched between the annular sidewall and the yoke and is fixed to the yoke, and the first vibration portion and the second vibration portion cover two opposite ends of the annular sidewall, respectively.

3. The sounding device as described in claim 2, wherein the yoke is formed into one piece.

4. The sounding device as described in claim 2, wherein the first sidewall comprises a connecting end connected to the bottom wall and a free end, wherein the free end is provided with at least one limiting slot, and the support arm is provided with at least one limiting portion engaging with a wall of the at least one limiting slot, so as to connect the first sidewall and the support arm.

5. The sounding device as described in claim 4, wherein the yoke is formed into one piece.

6. The sounding device as described in claim 4, wherein the at least one limiting slot comprises a plurality of limiting slots that is spaced apart from each other along a circumferential direction of the first sidewall, and the at least one limiting portion comprises a plurality of limiting portions arranged in one-to-one correspondence to the plurality of limiting slots.

7. The sounding device as described in claim 6, wherein the yoke is formed into one piece.

8. The sounding device as described in claim 1, wherein the yoke is formed into one piece.

9. The sounding device as described in claim 1, wherein the first groove is of a same size as the second groove.

10. The sounding device as described in claim 9, wherein the yoke is formed into one piece.

11. The sounding device as described in claim 1, wherein the first magnetic body comprises a first surface in contact with a bottom of the first groove, and a second surface opposite to the first surface; the second magnetic body comprises a third surface in contact with a bottom of the second groove, and a fourth surface opposite to the third surface; and the magnetic circuit unit further comprises a first pole plate adjacent to the second surface, and a second pole plate adjacent to the fourth surface.

12. The sounding device as described in claim 11, wherein the yoke is formed into one piece.

13. The sounding device as described in claim 2, wherein the first vibration portion comprises a first diaphragm covering one end of the annular sidewall, and a first voice coil connected to one side of the first diaphragm close to the first magnetic body; the second vibration portion comprises a second diaphragm covering one end of the annular sidewall away from the first vibration portion, and a second voice coil connected to one side of the second diaphragm close to the second magnetic body; and the first voice coil is suspended in a gap formed between the first magnetic body and a wall of the first groove, and the second voice coil is suspended in a gap formed between the second magnetic body and a wall of the second groove.

14. The sounding device as described in claim 13, wherein the yoke is formed into one piece.

15. The sounding device as described in claim 13, wherein the first diaphragm comprises a first voice membrane fixed to the annular sidewall, a first dome attached to a middle portion of the first voice membrane, and a first connector connected to the first dome, wherein the first connector is located between the first voice coil and the first magnetic body and supports and fixes the first voice coil; the first magnetic body is configured to drive the first voice coil to vibrate so as to enable the first connector to drive the first dome to vibrate; and the second diaphragm comprises a second voice membrane fixed to the annular sidewall, a second dome attached to a middle portion of the second voice membrane, and a second connector connected to the second dome, wherein the second connector is located between the second voice coil and the second magnetic body and supports and fixes the second voice coil, and the second magnetic body is configured to drive the second voice coil to vibrate so as to enable the second connector to drive the second dome to vibrate.

16. The sounding device as described in claim 15, wherein the yoke is formed into one piece.

17. The sounding device as described in claim 15, wherein the vibration system further comprises a first damper and a second damper that are provided between the first dome and the second dome, a first support member sandwiched between the first dome and the first damper, and a second support member sandwiched between the second dome and the second damper; an avoiding through hole for avoiding the first damper and the second damper is correspondingly formed in the support arm; and one side of the first damper away from the first support member is fixed to the bracket, and one side of the second damper away from the second support member is fixed to the bracket.

18. The sounding device as described in claim 17, wherein the yoke is formed into one piece.

19. The sounding device as described in claim 1, wherein the yoke is formed into one piece.

* * * * *